United States Patent [19]

Fisher

[11] 3,992,091

[45] Nov. 16, 1976

[54] ROUGHENED IMAGING SURFACE FOR CLEANING

[75] Inventor: Donald J. Fisher, Pittsford, N.Y.

[73] Assignee: Xerox Corporation, Stamford, Conn.

[22] Filed: Sept. 16, 1974

[21] Appl. No.: 506,135

[52] U.S. Cl. ..... 355/15; 15/256.52

[51] Int. Cl.[2] ..... G03G 21/00

[58] Field of Search ..... 15/256.52, 1.5 R; 96/1.5, 1 E, 1.4; 427/76; 355/3 DR, 15; 346/74 P; 250/315, 326; 118/637

[56] References Cited

UNITED STATES PATENTS

| | | | |
|---|---|---|---|
| 2,939,029 | 5/1960 | Wahlig | 250/315 |
| 3,185,968 | 5/1965 | Hammond | 346/74 P |
| 3,399,060 | 8/1968 | Clancy | 96/1.5 |
| 3,519,819 | 7/1970 | Gramza et al. | 250/315 |
| 3,552,850 | 1/1971 | Royka et al. | 355/1.5 |
| 3,559,570 | 2/1971 | Martel et al. | 118/637 |
| 3,566,786 | 3/1971 | Kaufer et al. | 118/637 |
| 3,674,477 | 7/1972 | Carlson | 96/1.5 |
| 3,801,315 | 4/1974 | Gundlach et al. | 96/1.4 |
| 3,848,993 | 11/1974 | Hasiotis | 355/15 |
| 3,871,881 | 3/1975 | Mikelsons | 96/1.5 |

*Primary Examiner*—Mervin Stein
*Assistant Examiner*—Douglas Salser

[57] ABSTRACT

Cleaning imaging material from a xerographic imaging surface with a cleaning blade with reduced friction between the blade and the surface is provided without image degredation by an appropriately roughened surface, which roughness is formed on the photoconductive surface by substrate preetching to provide a final or post coated roughness pattern of 3 to 5 microns and less than 20 microns.

2 Claims, 2 Drawing Figures

ROUGHENED IMAGING SURFACE FOR CLEANING

Figure 2:
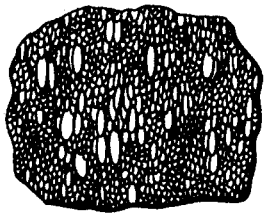

This invention relates to electrostatographic plates and imaging systems and, more particularly, to a roughened imaging surface for cleaning electrostatographic image developer material from an imaging surface, particularly with a cleaning blade, and to a method of making this surface.

The blade cleaning of imaging materials from a smooth reusable imaging surface in electrostatography is well known. In conventional xerography, for example, a latent electrostatic image is optically formed on a smooth photoconductive imaging surface and then developed by selectively depositing on the latent image a finely divided dry electroscopic visible image developer material known as toner. This toner image may then be electrostatically transferred and permanently fixed to a support surface such as paper. However, after such transfer, residual toner remains on the photoreceptor plate which for reuse thereof must be removed by a cleaning operation. This cleaning of residual toner from the photoreceptor must be accomplished rapidly and thoroughly yet without damage to the delicate photoreceptor, and the removed toner must be appropriately disposed of. The residual toner is tightly retained on the photoconductive surface and is difficult to remove. This retention is believed to be caused both by electrical charge attractions and also by Van der Waals forces that prevent complete transfer of the toner to the support surface. Thus, cleaning of the imaging surface is a difficult technical problem in practical xerography. Conventional types of photoreceptor cleaning devices include brushes, webs and blades. Blade cleaning has advantages in savings in space, power, and toner contamination. It has generally been considered desirable from all of these cleaning systems to maintain the imaging surface as smooth as possible, preferably highly polished to a mirror-like surface finish.

Exemplary xerographic photoreceptor dry toner blade cleaning apparatus is disclosed in U.S. Pat. Nos. 3,438,706, issued Apr. 15, 1969, to H. Tanaka et al.; 3,552,850, issued Jan. 5, 1971, to S. F. Royka et al.; 3,634,077, issued Jan. 11, 1972, to W. A. Sullivan; 3,660,863; issued May 9, 1972, to D. P. Gerbasi; 3,724,019, issued Apr. 3, 1973, to Alan L. Shanly; 3,724,020, issued Apr. 3, 1973, to Henry R. Till; and 3,740,789, issued June 26, 1973, to Raymond G. Ticknor. Pending allowed applications include U.S. applications Ser. No. 356,985, filed May 3, 1973, by Richard E. Smith (D/73001) and Ser. No. 356,986, filed May 3, 1973, by Christ S. Hasiotis (D/73196). Toner cleaning systems with polyurethane cleaning blades operating against smooth selenium alloy photoreceptor drums are commercially embodied in the Xerox Corporation "4000" and "3100" xerographic copiers.

The present invention represents a development in the above-cited technology, usable with such cleaning blades without other modifications. These references are incorporated by reference in the present specification to the extent relevant, although they are not a part of my invention. The plate of the invention may also be usable with brush or web cleaning systems for reducing, or localizing to high spots, the photoreceptor toner filming often experienced in these systems.

Blade edge tuck-unders from the high frictional forces on the cleaning blade against a smooth selenium surface have been a serious problem. Even partial failure of the cleaning blade edge at any point can cause non-image toner deposition to appear in streaks or smears on the copy sheets.

In toner blade cleaning, the toner is not being doctored, rather all toner is preferably being totally removed by the cleaning blade in a single rotation of the photoreceptor drum or belt surface. The entire surface must be thoroughly cleaned thousands of times without damage. The cleaning loads on the blade are uneven, both short term and long term, because the location, density and tenacity of the residual toner varies widely over the surface, depending on the images, the exposures, the surface charges, the toner development, the image location, etc. The required frictional forces for effective blade cleaning have been high, particularly for the desired combination of a relatively soft elastomeric blade cleaning tip edge tightly engaging an imaging surface, which imaging surface must be smooth enough to provide high optical resolution images. Unless carefully controlled these frictional forces can also result in the generation of excessive pressure or heat, resulting in physical and chemical changes in the toner, smearing of toner materials onto the photoreceptor or blade, excessive photoreceptor or blade wear, or other problems, especially in higher speed machines. Thus, cleaning dry toner from a photoreceptor presents extremely critical requirements not normally found in other cleaning fields, and blade cleaning systems suitable for other fields and applications, e.g., cleaning or doctoring systems for metal gravure rollers or inking rollers or paper mill rollers or adhesive applicators, are not normally appropriate.

There are, of course, literally thousands of patents teaching various cleaning or doctoring blades in numerous such non-analogous applications. Most such non-analogous blade cleaning systems are designed for, and teach operation in, totally different environments such as where a liquid or semi-liquid is partially or wholly removed from a roller of metal or other material far less susceptible of damage than a reuseable photoreceptor surface. Obviously, the blade cleaning of liquid materials is inherently non-analogous, since such materials are self-lubricating and can provide much lower cleaning frictions as well as surface protective filming.

The interdependent high frictional cleaning force requirements for dry toner blade cleaning normally requires in practical xerographic cleaning systems the use of lubricant materials added in some manner to reduce the high friction between the cleaning blade edge and the photoreceptor surface, such as waxes, metal stearates, etc. Examples of such lubricants and methods of applying them are disclosed, for example, in the above-incorporated Royka et al, U.S. Pat. No. 3,552,850.

The peculiar problems of dry toner removal are further aggravated by the fact that accumulated toner, plus any added lubricants, builds up at the cleaning edge against the photoreceptor surface. This provides a particulate seal assisting in trapping further toner particles approaching the blade edge. However, along with other blade edge contaminants, such as paper fibers, it adds to the frictional loads on the blade.

All of the above-noted toner blade cleaning problems are highly aggravated by low relative humidity environments. With low humidity the toner becomes more tenacious and difficult to remove. It retains electrical charges longer, and triboelectric charges may be generated from the cleaning action itself. The tendency for blade to drum adhesion increases substantially, and gross blade failures, such as total blade tuck-under are more likely to occur.

A chiseling type blade cleaning system such as that of the above-incorporated Gerbasi U.S. Pat. No. 3,660,863, is desirable for complete cleaning yet is particularly susceptible to frictional blade failure because the blade resiliently engages the photoreceptor surface extending toward the direction of surface motion and is, therefore, subjected to increasing compression forces rather than tension forces as the friction increases between the blade and photoreceptor. Yet a blade material which is sufficiently rigid to withstand all blade tuck-under or other deformation forces does not provide the other needed blade properties of sufficient deformability to continuously conform to the entire photoreceptor surface and provide microscopic cleaning engagement therewith without damaging it.

The improvement disclosed herein provides the advantages of the prior blade cleaning system, and allows the use of previously known blades, yet overcomes many of the above-described disadvantages and cleaning blade failure modes. In particular, it has been found that selective roughing of the photoreceptor surface can reduce cleaning blade friction therewith without sacrificing cleaning or imaging quality significantly.

Figure 1:
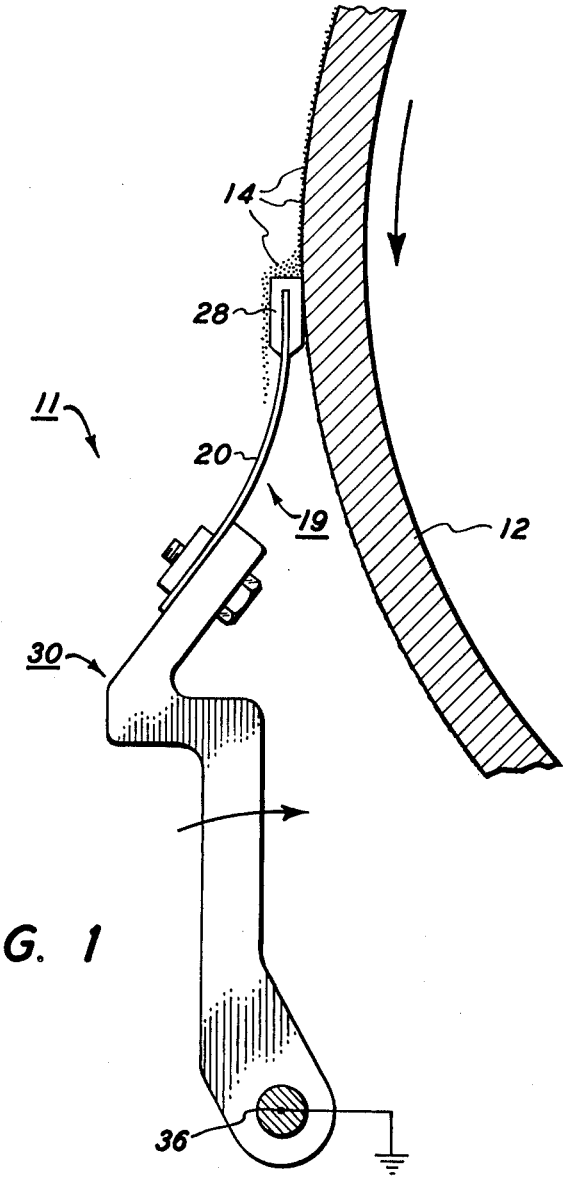

Further objects, features and advantages of the present invention pertain to the particular article, apparatus and details whereby the above-mentioned aspects of the invention are attained. Accordingly, the invention will be better understood by reference to the following description and to the drawings forming a part thereof, which are substantially to scale except as otherwise noted herein wherein:

FIG. 1 is a partially cross-sectional side view of an exemplary xerographic drum, in an exemplary blade cleaning system, in accordance with the present invention; and FIG. 2 is a magnified plan view of a portion of a xerographic plate surface of FIG. 1 in accordance with the present invention.

Referring now to the drawings, there is illustrated in FIGS. 1 and 2 an exemplary xerographic plate 12 being cleaned in an exemplary cleaning system 11 in accordance with the present invention. Mechanical details of the system 11 are more fully described in the above-cited allowed U.S. application Ser. No. 356,985, filed May 3, 1973, by Richard E. Smith. The particular disclosed exemplary cleaning system 11 is shown in cleaning engagement with a relevant portion of a xerographic system photoreceptor drum 12 with an imaging surface on which toner 14 has been developed, and from which the residual toner 14 is being removed by a cleaning blade 19.

Other components of conventional or suitable xerographic or other electrostatographic systems are fully disclosed in the above-cited and other references, and details thereof need not be disclosed herein. It is contemplated that the disclosed plates are applicable in the cleaning and removing of almost any type of image developer material, including, but not limited to, the well-known two-component (toner plus carrier) types. Exemplary patents disclosing developer comositions include U.S. Pat. Nos. 2,618,551 to Walkup, 2,618,552, to Wise; 2,663,415 to Walkup and Wise; 2,659,670 to Copley; 2,788,288 to Rheinfrank and Jones; and U.S. Reissue Pat. No. Re25,136 to Carlson. Generally such toners comprise triboelectrically chargeable and thermally or vapor fusable pigmented resins, having a particle diameter of between about 1 and 30 microns.

The cleaning blade 19 is sufficiently rigid to resist blade tuck-under even under low humidity conditions and yet has an elastomer cleaning edge of known or suitable materials which are sufficiently soft to provide a cleaning seal and protect the imaging surface of the plate 12 from abrasion or damage, especially where this surface is bare selenium metal, selenium alloy, or an uncoated organic photoconductor.

The exemplary cleaning system 11 disclosed here consists basically of a rigid blade support arm unit 30 pivoted about and axis 36 to which the cleaning blade unit 19 is mounted by a blade clamping arrangement. The blade unit 19 comprises an elastomer cleaning tip portion 28 mounted to the outer (free) edge of a thin main blade portion 20 for resiliently engaging and cleaning the photoreceptor surface 14. Additional associated means may be provided for removal and/or recirculation of the blade cleaned toner 14, as taught in several of the above-cited toner blade cleaning patents and applications.

The main blade portion 20 here is a continuous sheet of thin, planar non-elastomeric material, preferably thin sheet metal such as stainless steel shimstock extending the entire axial width of the photoreceptor surface. It has opposing parallel spaced edges, one of which is mounted to the support arm 30. The other, or free edge continuously supports the elastomer cleaning tip portion 28, which extends evenly therealong. The entire blade unit 19 is flexibly cantilever mounted from the support arm 30. This allows the resiliency of the main portion 20 to be utilized for loading the blade unit 19 against the photoreceptor surface uniformly.

The elastomer material of the cleaning tip 28 may be of any suitable material, such as polyurethane, including those selected from the disclosure of the above-cited Gerbasi U.S. Pat. No. 3,660,863 and the Royka et al. U.S. Pat. No. 3,552,850. Preferably it is elastomeric in the range of 50–80 Shore A durometer and has suitable abrasion resistance. Only a sharp cleaning edge or corner engages the photoreceptor 12.

Referring now to FIG. 2 there is shown a magnified section plan view of an exemplary photoreceptor surface in accordance with the present invention. In this embodiment, this is a magnified view of a small area of the FIG. 1 photoreceptor 12 outer surface cleaned of toner.

While the present invention is not limited to a specific photoconductor, either in terms of materials or configurations, the examples disclosed herein relate to the widely commercially known selenium alloy photoreceptor drums utilized in the Xerox 4000 copier. These and similar photoreceptors may be conventionally constructed in accordance with known techniques and materials except for the specific differences noted in this specification. For these drums an originally smooth aluminum cylindrical drum forms the substrate, on which there is vapor deposited a thin layer of approximately 63% selenium and 37% arsenic to form the photoconductive layer. An appropriate exemplary reference is U.S. Pat. No. 2,822,300, issued Feb. 4, 1958, to E. F. Mayer et al.

The present distinction over this prior art photoconductive plate and its method of manufacture lies in the modification of the outer surface of the photoreceptor to provide a critical range of surface roughness which provides significant reductions in the coefficient of friction between the photoreceptor surface and an engaging cleaning blade. Greater than 30% reductions in coefficient of friction values have been observed over smooth photoreceptor surfaces, while maintaining copy quality and toner cleaning comparable to smooth surfaces for a large number of copies, and even without the use of any lubricant additive material.

It will be appreciated that the ranges in surface roughness disclosed herein will vary somewhat due to variations in measurements, testing techniques, material, etc. Also, the coefficient of friction is between two dissimilar materials, one of which is an elastomer, and will vary with varying configurations, pressures, and materials.

Being able to reduce friction sufficiently to remove the need for an additional lubricant material (besides toner itself) between the blade and the imaging surface is highly advantageous. Such lubricant materials can have a number of undesirable effects on copy quality, developer life, etc.

The preferred method of manufacturing the finely roughened photoreceptor plate herein is by chemically etching the drum blank or substrate before it is coated with the photoconductive material. However, other known or suitable techniques, such as mechanical shot or grit blasting, cross-knurling, grinding, etc., of the substrate may be appropriate providing the appropriate desired surface configuration can be provided.

The present invention is particularly directed toward bare (uncoated) selenium alloy surfaced photoelectric plates, which have unique surface cleaning problems, since, unlike many organic photoreceptors, the surface conditions cannot be readily modified by adding other materials, coatings, or the like.

Referring now to the magnified surface view of FIG. 2, this drawing was made from an actual surface micrograph of approximately 200X magnification of the finished imaging surface. It may be seen that the vast majority of this surface is covered by a fine uniform continuous pattern of smooth closely spaced recesses averaging approximately 0.003 to 0.005 millimeters (3 to 5 microns) in lateral dimensions. Interspersed across the same surface, however, are some occasional larger depressions of approximately 10 by 20 microns, giving an "alligator skin" appearance. The average depth or height of all of these surface recesses is approximately 0.001 to 0.002 millimeters (1 to 2 microns), and preferably should not be substantially greater than this so as not to trap toner in sites which cannot be cleaned.

The finished imaging surface can be prepared by one or more of the following exemplary processes. In one, smooth aluminum drum surface (substrate) is prepared in the conventional manner, as if for a conventional smooth uniform photoconductive overcoating. However, prior to the conventional deposition of the photoconductive material, the drum can be treated, for example, in a solution of 5% sodium carbonate and 1% borax maintained at 180° F for an appropriate time period, then be rinsed and etched in a 15% nitric acid solution for approximately 15 seconds, rinsed again, and dried. Then the drum can be conventionally vacuum overcoated with the previously described selenium alloy photoconductive material. Another drum substrate etching solution is a bath of 3% sodium carbonate and 3% trisodium phosphate in demineralized water at 175° F, agitated, in which the drum substrate is held between 1 and 60 minutes, then rinsed in agitated demineralized water for one-half minute, then spray rinsed with demineralized water for 1 minute, then over dried for 10 minutes at 160° F forced air.

It has been experimentally observed that there is an important upper limit on the allowable size of the larger surface irregularities, of approximately the above-noted 10 to 20 micron width. Above this upper limit there is an observable toner "print-out", as background spots, on the copy sheet, apparently due to toner being captured by these large recesses and not being adequately cleaned by the cleaning blade. Thus, a substantially rougher surface pattern is not useable as an imaging surface even though it may provide a desired reduction in friction. It is also postulated that larger surface irregularities would cause increased blade wear.

As previously indicated, other methods for forming the surface may be utilized. However, for any method tried, it has been experimentally observed that there is also an important lower limit to the surface pattern dimensions. That is, a too lightly etched substrate results in a higher coefficient of friction than for even a virgin (smooth) drum surface. A static coefficient of friction of 3.4 has been observed for a too lightly etched drum substrate as compared to 2 for a more heavily etched substrate providing a final imaging surface within the previously specified range of approximately 3 to 5 microns.

In contrast to the above-described upper and lower limit conditions, it has been demonstrated that providing a surface in accordance with the teachings herein on the imaging surface allows normal imaging and background yet provides a substantially lower coefficient of static and dynamic friction.

It will be appreciated that the plate area referred to herein is the imaging area. End areas of a drum, belt or web outside of the blade contact area will not have to have the disclosed surface.

While the photoconductive plate, its method of manufacture and the cleaning system disclosed herein are all presently considered to be preferred, it is contemplated that further variations and modifications within the purview of those skilled in the art can be made herein. The following claims are intended to cover all such variations and modifications as fall within the true spirit and scope of the invention.

What is claimed is:

1. In an electrostatographic image reproducing apparatus including a selenium material imaging surface developable with toner material, and further including a cleaning blade for deformably engaging said imaging surface to remove such toner material therefrom, the improvement in said apparatus wherein said imaging surface has a substantially uniformly and continuously roughened surface with a surface roughness pattern averaging 3 to 5 microns in lateral dimensions, but not substantially exceeding 20 microns in lateral dimensions and 2 microns in depth, said roughness pattern reducing friction between said cleaning blade and said imaging surface in comparison to a smooth imaging surface without adversely affecting image reproduction.

2. The electrostatographic image reproducing apparatus of claim 1, wherein said roughened imaging surface comprises an etched conductive metal substrate etched with said surface roughness pattern and overcoated with a thin uniform layer of said selenium photoelectric material.

* * * * *